US011278938B2

(12) United States Patent
Matsushima et al.

(10) Patent No.: US 11,278,938 B2
(45) Date of Patent: Mar. 22, 2022

(54) OPTICAL SORTER

(71) Applicant: SATAKE CORPORATION, Tokyo (JP)

(72) Inventors: Hideaki Matsushima, Tokyo (JP); Kohei Kishimoto, Tokyo (JP)

(73) Assignee: SATAKE CORPORATION, Tokyo (JP)

( * ) Notice: Subject to any disclaimer, the term of this patent is extended or adjusted under 35 U.S.C. 154(b) by 0 days.

(21) Appl. No.: 16/961,503

(22) PCT Filed: Dec. 14, 2018

(86) PCT No.: PCT/JP2018/046107
§ 371 (c)(1),
(2) Date: Jul. 10, 2020

(87) PCT Pub. No.: WO2019/155764
PCT Pub. Date: Aug. 15, 2019

(65) Prior Publication Data

US 2020/0338600 A1 Oct. 29, 2020

(30) Foreign Application Priority Data

Feb. 6, 2018 (JP) ..... JP2018-019534

(51) Int. Cl.
*B07C 5/34* (2006.01)
*B07C 5/342* (2006.01)
*B07C 5/36* (2006.01)

(52) U.S. Cl.
CPC ..... *B07C 5/3425* (2013.01); *B07C 5/366* (2013.01)

(58) Field of Classification Search
CPC ..... B07C 5/3425; B07C 5/366; B07C 2501/0018; G01N 2021/8592; G01N 2015/03; G01N 2015/149
See application file for complete search history.

(56) References Cited

U.S. PATENT DOCUMENTS 3,738,484 A * 6/1973 Hoover ..... B07C 5/366 209/581
3,909,401 A * 9/1975 Thompson ..... B07B 1/46 209/412

(Continued)

FOREIGN PATENT DOCUMENTS

CN 201091964 Y 7/2008
CN 105057289 A 11/2015

(Continued)

OTHER PUBLICATIONS

Office Action in China Application No. 201880086966.8, dated Jul. 5, 2021, 7 pages.

*Primary Examiner* — Joseph C Rodriguez
(74) *Attorney, Agent, or Firm* — Crowell & Moring LLP

(57) ABSTRACT

An object of the present invention is to provide an optical sorter which enables to eliminate occurrence of welding distortion on a frame and simply attain high positional accuracy of component members attached to the frame. There is provided an optical sorter according to the present invention, comprising: a chute arranged to slope and to allow a raw material as objects to be sorted out to flow down; optical detection means for detecting the objects to be sorted out dropping from a lower end of the chute; ejector means for sorting out and excluding the objects to be sorted out on the basis of a detection result by the optical detection means; and a discharge hopper that separately discharges the objects sorted out by the ejector means, wherein further comprising a frame having a pair of right and left sidewalls which are screw-fixed to a base, the chute, the optical detection means, the ejector means and the discharge hopper are attached to the frame, and the sidewalls of the frame are coupled with braces in a diagonal shape.

6 Claims, 7 Drawing Sheets

(56) References Cited

U.S. PATENT DOCUMENTS

| | | | | | |
|---|---|---|---|---|---|
| 4,096,949 | A * | 6/1978 | Hoover | B07C 5/3425 | 209/564 |
| 4,426,005 | A * | 1/1984 | Satake | B07C 5/366 | 209/581 |
| 4,940,850 | A * | 7/1990 | Satake | B07C 5/366 | 209/580 |
| 5,638,961 | A * | 6/1997 | Satake | B07C 5/3425 | 209/580 |
| 5,779,058 | A * | 7/1998 | Satake | B07C 5/3425 | 209/581 |
| 5,994,656 | A * | 11/1999 | Satake | B07C 5/365 | 209/580 |
| 6,683,266 | B2 * | 1/2004 | Maejima | A01C 1/06 | 209/587 |
| 7,861,867 | B1 * | 1/2011 | Derrick | B07B 1/12 | 209/412 |
| 9,024,223 | B2 * | 5/2015 | Miyamoto | G01J 3/50 | 209/580 |
| 9,409,184 | B1 * | 8/2016 | Mickelson | B03B 9/00 | |
| 2015/0375270 | A1 * | 12/2015 | Ishizu | B07C 5/3425 | 209/580 |

FOREIGN PATENT DOCUMENTS

| | | | |
|---|---|---|---|
| JP | H 04-136343 | A | 5/1992 |
| JP | 2013-059718 | A | 4/2013 |
| JP | 5218374 | B2 | 6/2013 |
| JP | 5605172 | B2 | 10/2014 |
| KR | 10-2012-0135019 | A | 12/2012 |

* cited by examiner

OPTICAL SORTER

TECHNICAL FIELD

This application is a 371 application of PCT/JP2018/046107 having an international filing date of Dec. 14, 2018, which claims priority to JP2018-019534 filed Feb. 6, 2018, the entire content of each of which is incorporated herein by reference.

The present invention relates to an optical sorter which sorts out granular objects such as grains and resin pellets on the basis of colors and/or the like, and specifically relates to an optical sorter which enables to attain positional accuracy of component members attached to a frame.

BACKGROUND ART

There is conventionally known an optical sorter which sorts out a raw material composed of grains such as rice and wheat, resin pellets, coffee beans, or other granular objects into good articles and defective articles based on colors and/or the like and/or excludes foreign object mixed in a raw material based on colors and/or the like (refer to Patent Documents 1 and 2).

An optical sorter disclosed in each of Patent Documents 1 and 2 comprises a granular object feed part, an inclined chute, an optical sorting part and a discharge hopper.

In the optical sorter, granular objects which are a raw material are fed from the granular object feed part, then flow down on the surface of the inclined chute, drop from the lower end thereof, after that, are detected at the optical sorting part, are determined to be good or defective based on colors and/or the like, are sorted out into good articles and defective articles by excluding the defective articles, and then, are discharged separately as the good articles and the defective articles from the discharge hopper.

Now, each optical sorter above employs a structure of assembling a frame by welding and can cause welding distortion on the frame depending on the skill of a welding operator.

Since each optical sorter above also employs a structure of attaching to the frame, component members including the granular object feed part, the inclined chute, the optical sorting part and the discharge hopper, it is difficult to attain high positional accuracy of the component members when welding distortion occurs on the frame, which difficulty problematically largely affects sorting accuracy.

CITATION LIST

Patent Document

Patent Document 1: Japanese Patent No. 5218374
Patent Document 2: Japanese Patent No. 5605172

SUMMARY OF INVENTION

Technical Problem

Therefore, an object of the present invention is to provide an optical sorter which enables to eliminate occurrence of welding distortion on a frame and simply attain high positional accuracy of component members attached to the frame.

Solution to Technical Problem

In order to achieve the aforementioned object, there is provided an optical sorter according to the present invention;

comprising: a chute arranged to slope and to allow a raw material as objects to be sorted out to flow down; optical detection means for detecting the objects to be sorted out dropping from a lower end of the chute; ejector means for sorting out and excluding the objects to be sorted out on the basis of a detection result by the optical detection means; and a discharge hopper for separately discharging the objects sorted out by the ejector means, wherein the optical sorter further comprising: a frame having a pair of right and left sidewalls which are screw-fixed to a base; wherein the chute, the optical detection means, the ejector means and the discharge hopper are attached to the frame, and the sidewalls of the frame are coupled with braces in a diagonal shape.

In the present invention, the braces preferably couple the sidewalls on the front side of the sidewalk and the rear side of the sidewalls in a diagonal shape.

In the present invention, the chute is preferably attached to the frame on the front side of the sidewalls, and the braces preferably couple the sidewalls of the frame on the rear side of the chute.

In the present invention, the frame preferably comprises an electric equipment base arranged between the sidewalls and screw-fixed to the sidewalls, and the optical detection means and the ejector means are preferably arranged on the electric equipment base.

In the present invention, the frame preferably further comprises a top board, a feeder base and a dust collection duct arranged between the sidewalls and screw-fixed to the sidewalls, and a raw material tank is preferably placed and fixed onto the top board, a vibrating feeder that feeds granular objects stored in the raw material tank to the chute is preferably placed and fixed onto the feeder base, and the discharge hopper is preferably arranged on a front face of the dust collection duct in a state of being screw-fixed onto the base.

In the present invention, one or more of sorting units each including the chute, the optical detection means, the ejector means and the discharge hopper are preferably provided between the sidewalls of the frame.

Effects of Invention

The optical sorter according to the present invention employs a structure of screw-fixing the pair of sidewalls in the right-left direction onto the base to assemble the frame, thereby can eliminate occurrence of welding distortion on the frame, can secure rigidity of the frame by diagonally coupling the sidewalls of the frame with the braces, and can attain high positional accuracy of the chute, the optical detection means, the ejector means and the discharge hopper which are the component members attached to the frame through adjustments of the lengths of the braces.

Moreover, the optical sorter according to the present invention employs a structure of assembling the frame by screw-fixing in place of conventional welding, and thereby can simplify assembly steps.

When the braces couple the sidewalls on the front side of the sidewalls and the rear side of the sidewalls, the optical sorter according to the present invention can accurately attain high positional accuracy of the component members attached to the frame, and can improve rigidity of the frame.

When the chute is attached to the frame in the portion frontward of the sidewalls, and the braces couple the sidewalls of the frame in the portion rearward of the chute, the optical sorter according to the present invention can arrange the braces effectively using a space rearward of the chute.

When the frame has the electric equipment base arranged between the sidewalls and screw-fixed to the sidewalls, and the optical detection means and the ejector means are arranged on the electric equipment base, the optical sorter according to the present invention can improve rigidity of the frame by fixing the electric equipment base to the sidewalls, and facilitates attachments of the optical detection means and the ejector means to the frame.

When the frame further has the top board, the feeder base and the dust collection duct arranged between the sidewalls and screw-fixed to the sidewalls, and the raw material tank is placed and fixed onto the top board, the vibrating feeder that feeds granular objects stored in the raw material tank to the chute is placed and fixed onto the feeder base, and the discharge hopper is arranged on the front face of the dust collection duct in the state of being screw-fixed onto the base, the optical sorter according to the present invention can further improve the rigidity of the frame by fixing top board, the feeder base and the dust collection duct to the sidewalls, and facilitates attachments of the raw material tank, the vibrating feeder and the discharge hopper to the frame.

When a single or a plurality of sorting units each including the chute, the optical detection means, the ejector means and the discharge hopper are provided between the sidewalls of the frame, the optical sorter according to the present invention can be used as a single optical sorter or an optical sorter having functions to be obtained by providing a plurality of single optical sorters.

DESCRIPTION OF EMBODIMENTS

An embodiment of the present invention is described with reference to the drawings.

Figure 1:
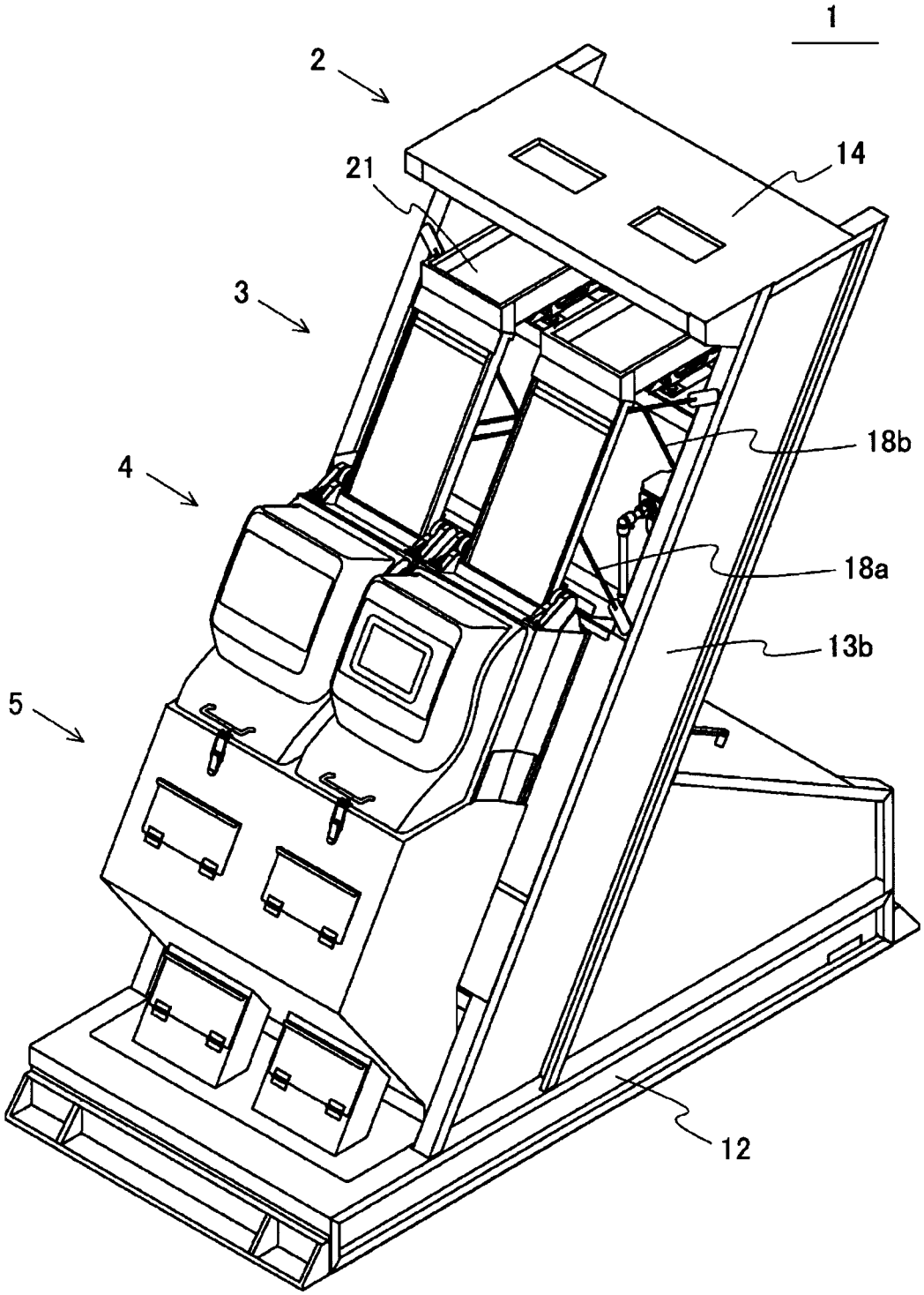
FIG. 1 is a perspective view of an optical sorter.
Figure 2:
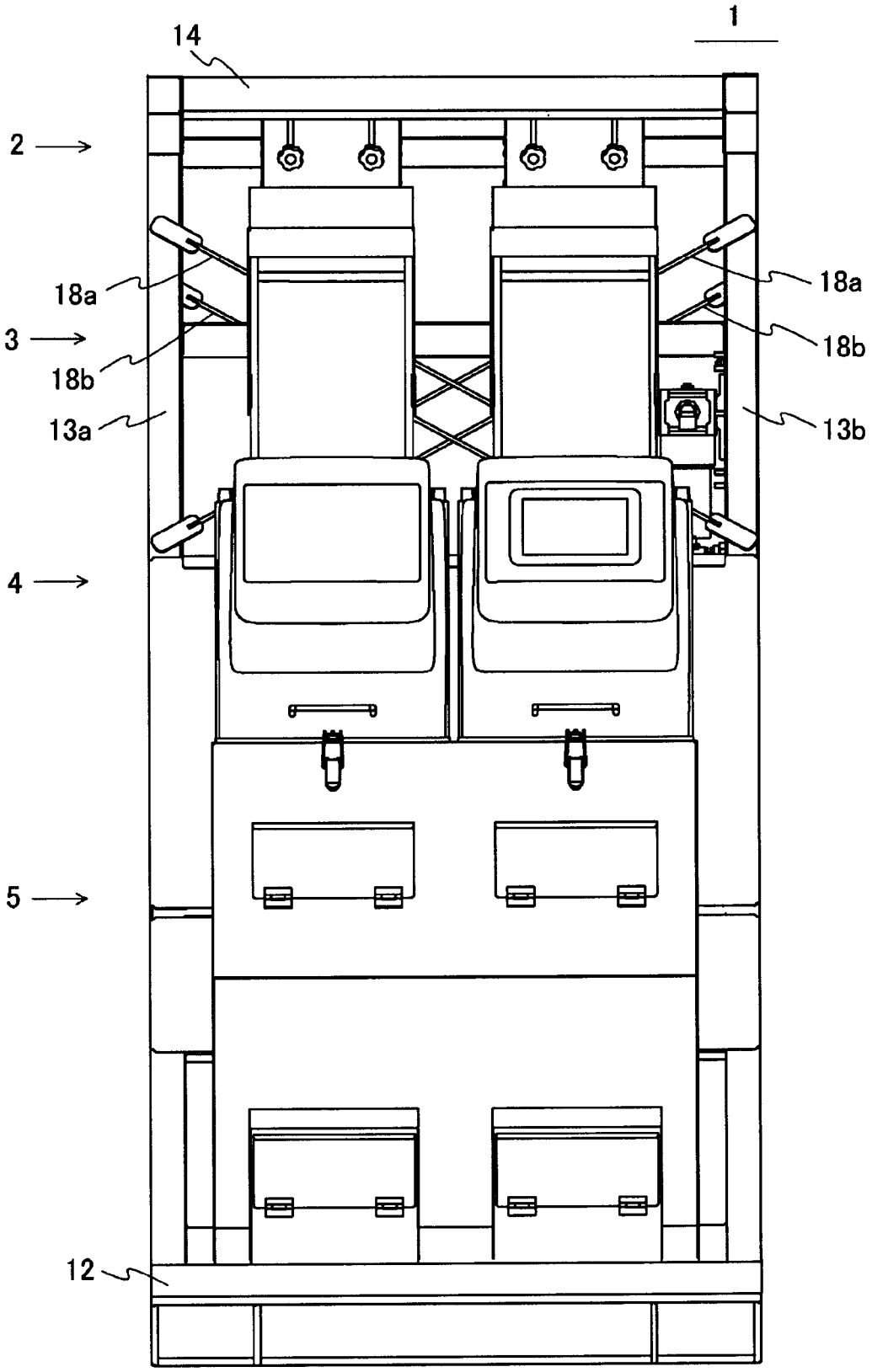
FIG. 2 is a front view of the optical sorter.
Figure 3:
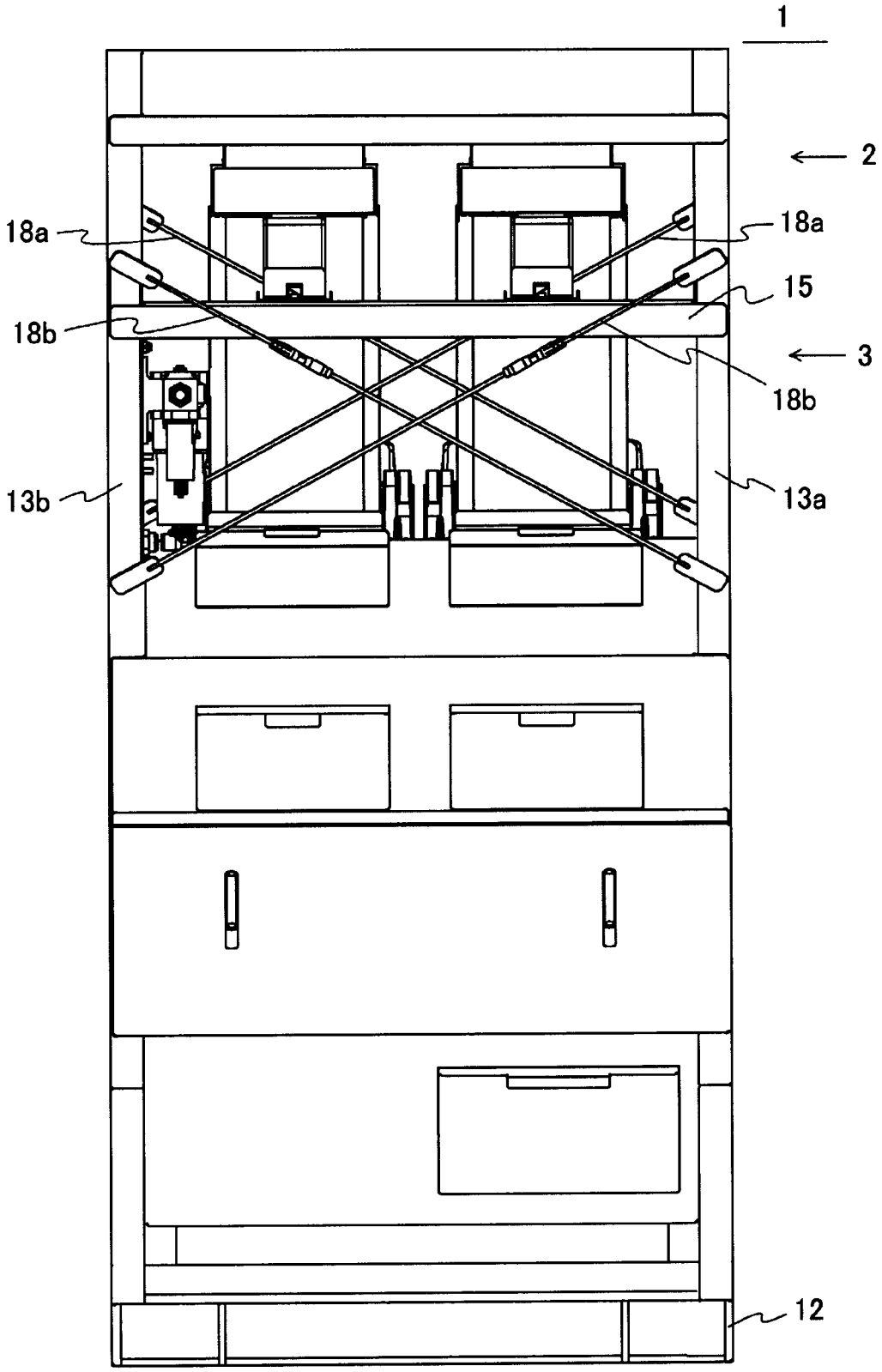
FIG. 3 is a rear view of the optical sorter.
Figure 4:
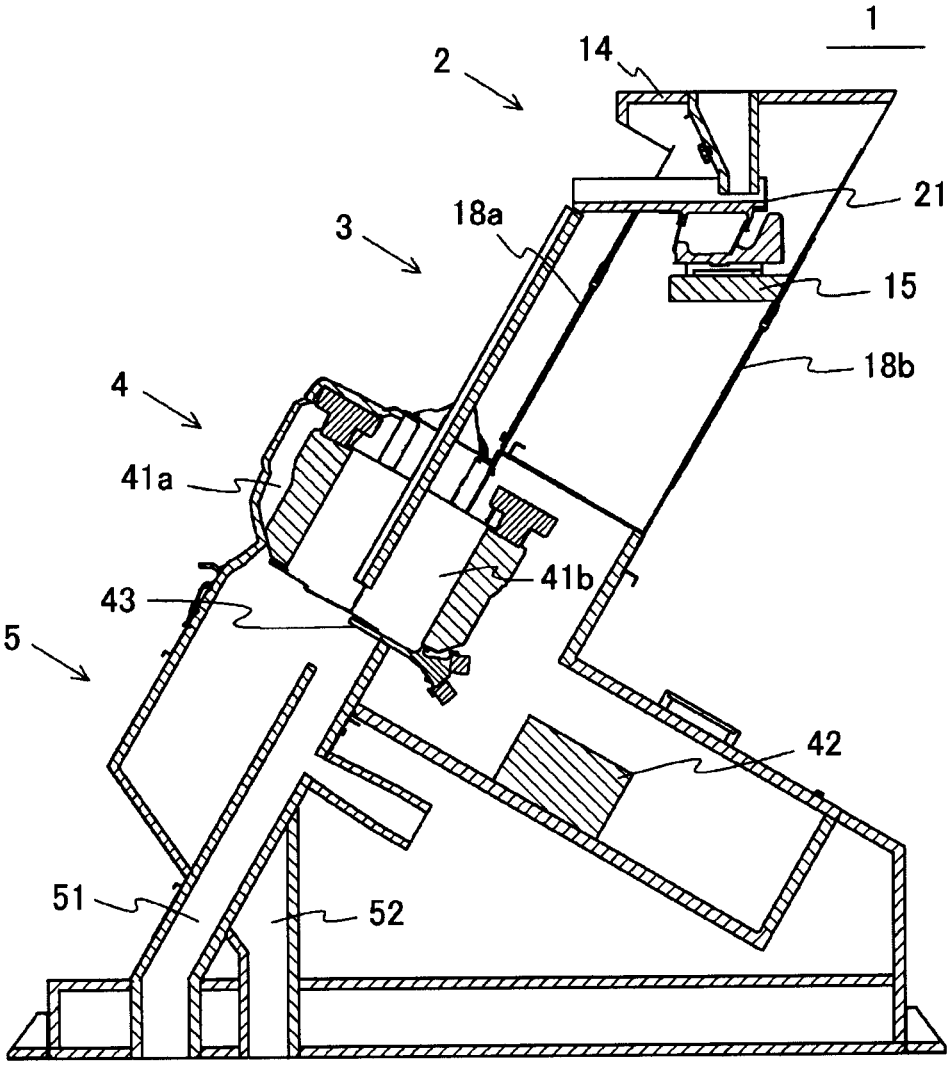
FIG. 4 is a schematic lateral sectional view of the optical sorter.

FIG. 1 shows a perspective view an optical sorter according to an embodiment of the present invention. FIG. 2 shows a front view of the optical sorter in FIG. 1. FIG. 3 shows a rear view of the optical sorter in FIG. 1. FIG. 4 shows a schematic lateral sectional view of the optical sorter in FIG. 1.

As shown in FIG. 1 to FIG. 3, an optical sorter 1 according to an embodiment of the present invention comprises two sets of sorting units arranged side by side, each unit including a granular object feed part 2, a chute 3, an optical sorting part 4 and a discharge hopper 5. The sorting units have substantially the same configurations, and the description is herein made based on one set of sorting unit.

The optical sorter 1 according to the embodiment of the present invention comprises: the granular object feed part 2 for feeding granular objects which are a raw material; the chutes 3 arranged to slope and to allow the granular objects to flow down; the optical sorting parts 4 for detecting the granular objects dropping from the lower ends of the chutes 3 and sorting out good articles from defective articles on the basis of the detection result; and the discharge hopper 5 for separating and discharging the granular objects sorted out by the optical sorting parts 4 into the good articles and the defective articles.

The granular object feed part 2 includes a raw material tank (not shown), and vibrating feeders 21 which feed the granular objects stored in the raw material tank to the chutes 3.

The chute 3 has a predetermined width and is arranged at a position below the distal end of the vibrating feeder 21 in the state of sloping, and allows the granular objects fed from the vibrating feeder 21 to freely flow down.

The optical sorting part 4 includes: a pair of optical detection devices 41*a* and 41*b* arranged on the front and rear sides of dropping trajectories of the granular objects dropping from the lower end of the chute 3; a determination device 42 which determines whether the granular objects are good articles or defective articles on the basis of image capturing signals of the optical detection devices 41*a* and 41*b*; and an ejector device which excludes the defective articles on the basis of the determination result of the determination device 42 thereby to sort out the granular objects into the good articles and the defective articles.

The discharge hopper 5 has a good article discharge path 51 and a defective article discharge path 52, and separates and discharges the granular objects sorted out by the ejector device into the good articles and the defective articles.

While the discharge hopper 5 is provided an integrated discharge hopper for the two sets of units arranged side by side herein, it is not necessarily required to have an integrated one but may have separate ones.

In the optical sorter 1, the granular objects stored in the raw material tank of the granular object feed part 2 are continuously fed to the chute 3 with the vibrating feeder 21, freely flow down in the state of spreading in the width direction on the surface of the chute 3, and after that, freely fall along predetermined trajectories from the lower end of the chute 3.

Images of the granular objects dropping from the lower end of the chute 3 are captured by image capturing means of the pair of optical detection devices 41*a* and 41*b* in the optical sorting part 4, and the determination device 42 determines whether the granular objects are good articles or defective articles by comparing, with thresholds, signal levels of a quantity of light and color components in an image capturing signal from the image capturing means, and the granular objects are sorted out into the good articles and the defective articles by the defective articles excluded from the predetermined trajectories with ejection of air by the ejector device on the basis of an exclusion signal sent from the determination device 42.

Then, the granular objects that are sorted out as the good articles are discharged from the good article discharge path 51 of the discharge hopper 5, and the granular objects that are sorted out as the defective articles are discharged from the defective article discharge path 52 of the discharge hopper 5, respectively.

Figure 5:
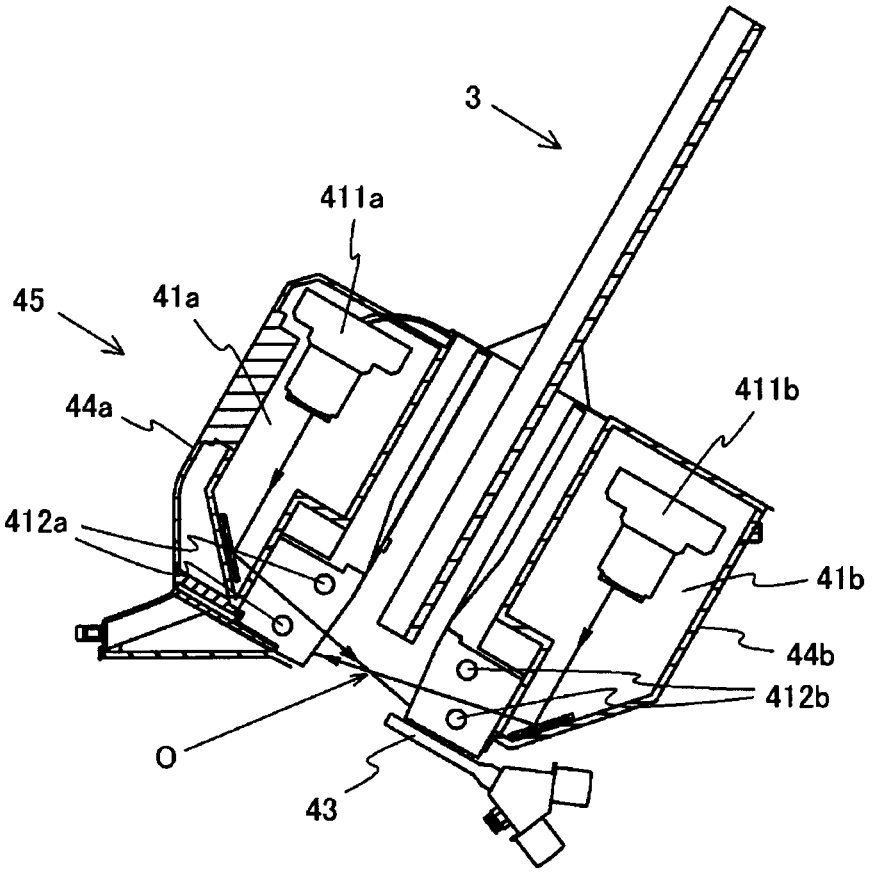
FIG. 5 is an explanatory diagram of optical detection devices.
Figure 6:
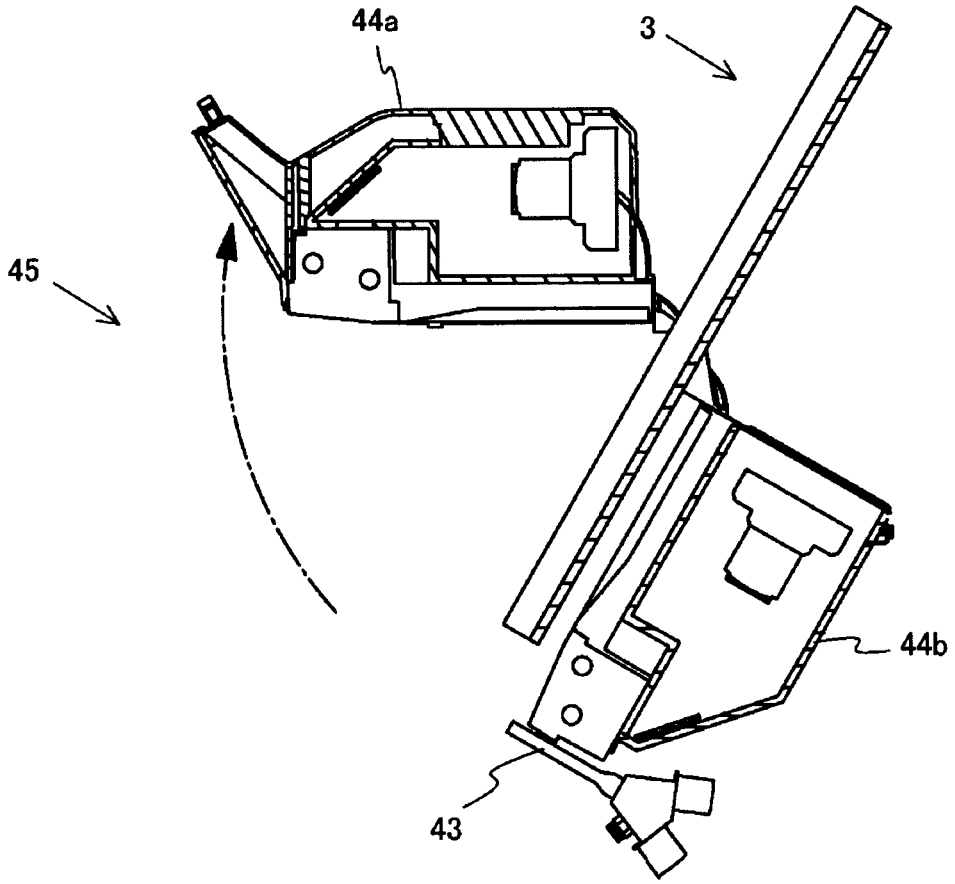
FIG. 6 is an explanatory diagram in the state where a front optical detection device is caused to pivot upward.

FIG. 5 shows an explanatory diagram of the optical detection devices. FIG. 6 shows an explanatory diagram of the optical detection devices in FIG. 5 in the state where the front optical detection device is caused to pivot upward.

The optical detection devices 41*a* and 41*b* include: image capturing means 411*a*, 411*b*, such as CCD cameras, which have built-in line sensors and/or area sensors, such as CCDs, with are able to handle granular objects freely falling in the state of spreading in the width direction from the lower end of the chute 3 and are able to receive light in a wavelength band of near infrared rays (NIR), visible light, ultraviolet rays or the like; lighting means 412*a*, 412*b*, such as fluorescent lamps, halogen lamps and LED light sources, which illuminate a detection position O on the dropping trajectories of the granular objects; and backgrounds which are backgrounds in capturing images of the granular objects at the detection position O with the image capturing means 411*a*, 411*b*.

The pair of optical detection devices 41*a* and 41*b* constitute a camera unit 45 by being arranged in a pair of front and rear covers 44*a* and 44*b* which are coupled so as to be able to be opened and closed at their top portions with a hinge.

The ejector device includes an ejector nozzle 43 which can, similarly to the optical detection devices 41*a* and 41*b*, handle granular objects freely falling in the state of spreading in the width direction from the lower end of the chute 3 and which can eject air selectively from a plurality of nozzle holes formed in the width direction; and an ejector drive device (not shown) which causes the ejector nozzle 43 to eject air on the basis of the exclusion signal sent from the determination device 42.

The ejector nozzle 43 may be integrally attached to the camera unit 45.

Figure 7:
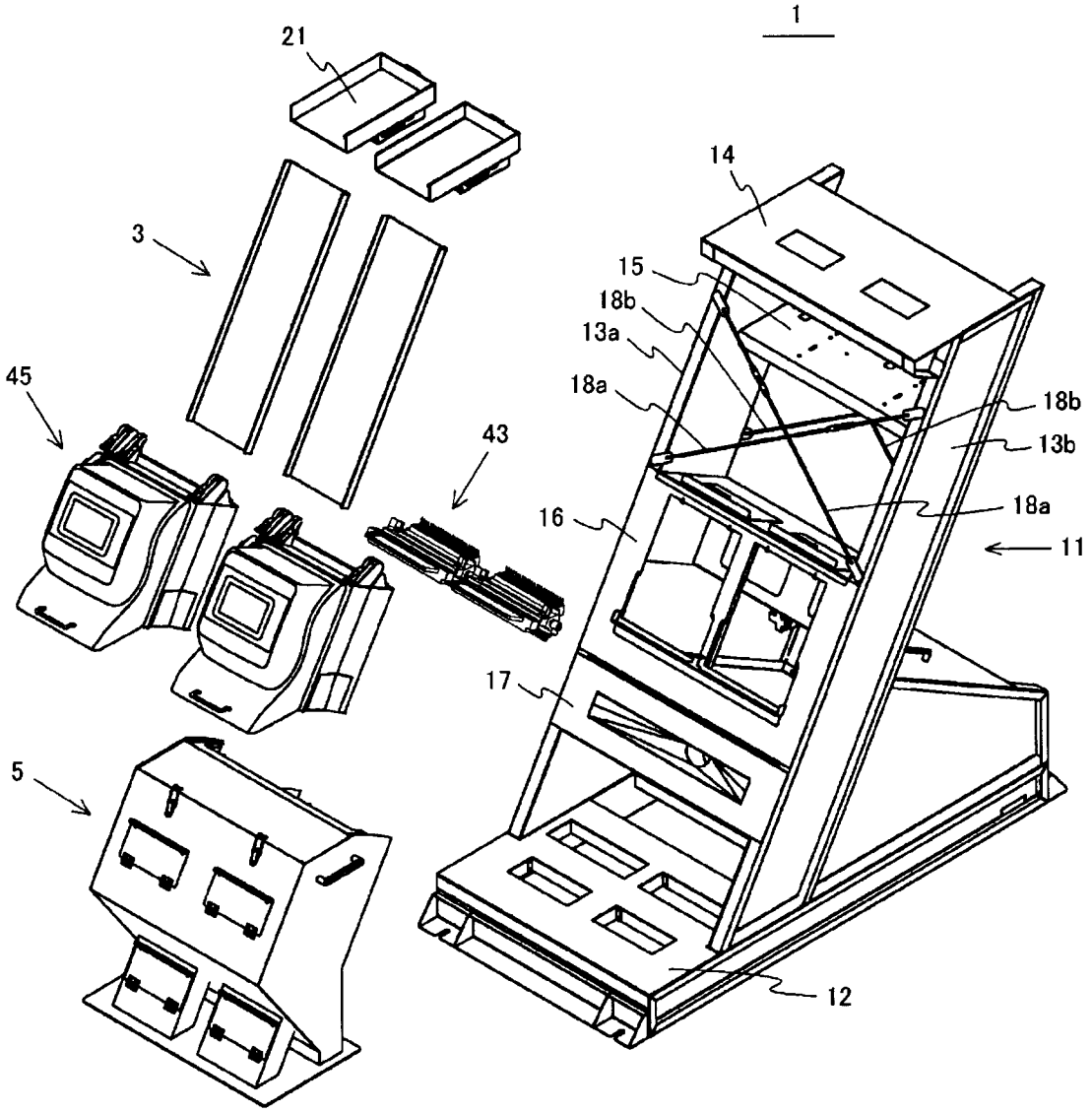
FIG. 7 is an exploded perspective view of the optical sorter.

FIG. 7 shows an exploded perspective view of the optical sorter in FIG. 1.

The optical sorter 1 according to the embodiment of the present invention includes: a base 12; a pair of right and left sidewalls 13*a* and 13*b* which are stood and screw-fixed onto the base 12; and a frame 11 having a top board 14, a feeder base 15, an electric equipment base 16 and a dust collection duct 17, each transversely provided between the sidewalls 13*a* and 13*b* and screw-fixed to the sidewalls 13*a* and 13*b*.

Further, in the frame 11, the sidewalls 13*a* and 13*b* are coupled with pairs of braces 18*a* and 18*b* in a diagonal shape on the front side of the sidewalls 13*a* and 13*b* and the rear side of the sidewalls 13*a* and 13*b*.

The braces 18*a* and 18*b* herein are known, each brace having two steel rods coupled with a turnbuckle. A coupling plate member is fixed to one end of the steel rod by welding or the like, and the coupling plate members are coupled to the front faces or the rear faces of the sidewall 13*a*, 13*b* with bolts or the like, and the braces 18*a* and 18*b* can be adjusted in terms of their lengths by rotating the turnbuckles to put the steel rods forward or backward.

The raw material tank (not shown) is placed and screw-fixed onto the top board 14 of the frame 11, and the vibrating feeders 21 are placed and screw-fixed onto the feeder base 15.

Moreover, on the electric equipment base 16, the determination devices 42 and electric equipment units (not shown) including the ejector drive device and the like are arranged as well as the camera units 45 and the ejector nozzles 43, and on the front face of the dust collection duct 17, the discharge hopper 5 is arranged in the state of being screw-fixed to the base 12.

Herein, the camera unit 45 is arranged on the electric equipment base 16 of the frame 11 in the state of sandwiching the chute 3 in the pair of the front and rear covers 44*a* and 44*b* and between the pair of optical detection devices 41*a* and 41*b*.

On the other hand, the chute 3 is attached to the frame 11 on the front side of the sidewalls 13*a* and 13*b*, and the braces 18*a* and 18*b* are arranged in a space formed on the rear side of the chute 3.

Since the optical sorter 1 according to an embodiment of the present invention employs a structure in which the pair of right and left sidewalls 13*a* and 13*b* are stood and screw-fixed onto the base 12, and the top board 14, the feeder base 15, the electric equipment base 16 and the dust collection duct 17 are transversely provided between the sidewalls 13*a* and 13*b* and screw-fixed to the sidewalls 13*a* and 13*b* to assemble the frame 11, welding distortion does not occur on the frame 11.

Further, since in the optical sorter 1, the sidewalls 13*a* and 13*b* of the frame 11 are coupled with the diagonal braces 18*a* and 18*b* crossing each other on the front and rear sides of the sidewalls 13*a* and 13*b*, rigidity of the frame 11 can be secured, and adjustments of the lengths of the braces 18*a* and 18*b* with the turnbuckles can simply attain high positional accuracy of component members such as the vibrating feeders 21, the chutes 3, the optical detection devices 41*a* and 41*b* and the ejector nozzles 43, which are attached to the frame 11.

Moreover, since the optical sorter 1 employs a structure of assembling the frame 11 by screw-fixing in place of a conventional welding structure, assembly steps can be simplified.

While in the optical sorter 1 according to the aforementioned embodiment of the present invention, two sets of sorting units each including the granular object feed part 2, the chute 3, the optical sorting part 4 and the discharge hopper 5 are arranged side by side, a single or three or more sets of sorting units may be arranged.

While in the aforementioned embodiment of the present invention, the optical sorting part 4 excludes defective articles, good articles may be excluded to sort out granular objects into the good articles and the defective articles. Moreover, foreign objects mixed in a raw material may be excluded to sort out the raw material from the foreign objects.

While in the aforementioned embodiment of the present invention, the ejector device exemplarily has the ejector nozzle 43 to exclude granular objects with air, the granular objects may be excluded by mechanical operation.

Needless to say, the configuration of the optical sorter 1 according to the present invention is not limited to that in the aforementioned embodiment but can be properly modified without departing from the scope of the present invention.

INDUSTRIAL APPLICABILITY

Since the optical sorter according to the present invention can eliminate occurrence of welding distortion by employing a structure of assembling the frame of a panel structure by screw-fastening, and enables high positional accuracy of component members attached to the frame to be simply and easily adjusted through adjustments of the lengths of braces, it is extremely high in practicality.

The invention claimed is:

1. An optical sorter comprising:

a chute arranged to slope and to allow a raw material as objects to be sorted out to flow down;

optical detector configured to detect the objects to be sorted out dropping from a lower end of the chute;

ejector configured to sort out and exclude the objects to be sorted out on the basis of a detection result by the optical detector; and a discharge hopper for separately discharging the objects sorted out by the ejector, wherein the optical sorter further comprising: a frame having a pair of right and left sidewalls which are screw-fixed to a base, wherein the chute, the optical detector, the ejector and the discharge hopper are attached to the frame, and the sidewalls of the frame are coupled with length adjustable braces in a diagonal shape and positions of at least the chute, the optical detector and the ejector are adjustable by adjustments of the lengths of the braces.

2. The optical sorter according to claim 1, wherein the braces couple the sidewalls on the front side of the sidewalls and the rear side of the sidewalls in a diagonal shape.

3. The optical sorter according to claim 1, wherein the chute is attached to the frame on the front side of the sidewalls, and the braces couple the sidewalls of the frame on the rear side of the chute.

4. The optical sorter according to claim 3, wherein the frame comprises an electric equipment base arranged between the sidewalls and screw-fixed to the sidewalls, and the optical detector and the ejector are arranged on the electric equipment base.

5. The optical sorter according to claim 4, wherein the frame further comprises a top board, a feeder base and a dust collection duct arranged between the sidewalls and screw-fixed to the sidewalls, and a raw material tank is placed and fixed onto the top board, a vibrating feeder that feeds granular objects stored in the raw material tank to the chute is placed and fixed onto the feeder base, and the discharge hopper is arranged on a front face of the dust collection duct in a state of being screw-fixed onto the base.

6. The optical sorter according to claim 1, wherein one or more sorting units each including the chute, the optical detector, the ejector and the discharge hopper are provided between the sidewalls of the frame.

* * * * *